United States Patent [19]

Lindstrom

[11] Patent Number: 4,542,847

[45] Date of Patent: Sep. 24, 1985

[54] DISPLAY CARTON

[75] Inventor: Robert O. Lindstrom, Bay Village, Ohio

[73] Assignee: SCM Corporation, New York, N.Y.

[21] Appl. No.: 610,076

[22] Filed: May 14, 1984

[51] Int. Cl.[4] ..... B65D 5/50

[52] U.S. Cl. ..... 229/16 D; 206/44 R

[58] Field of Search ..... 206/44 R, 45.13, 45.14, 206/45.19; 229/16 D

[56] References Cited

U.S. PATENT DOCUMENTS

| | | | |
|---|---|---|---|
| 3,185,382 | 5/1965 | Nunn | 206/44 R |
| 3,208,583 | 9/1965 | Kamps | 206/44 R |
| 3,302,777 | 2/1967 | Sparks | 206/44 R |
| 3,351,182 | 11/1967 | Greer et al. | 206/44 R |
| 3,669,251 | 6/1972 | Phillips, Jr. | 206/44 R |
| 3,696,940 | 10/1972 | Hoffman et al. | 206/44 R |
| 3,756,385 | 9/1973 | Steinbock | 206/44 R |
| 4,011,943 | 3/1977 | Galli et al. | 206/44 R |
| 4,116,330 | 9/1978 | Ellis | 206/44 R |

*Primary Examiner*—Joseph Man-Fu Moy

*Attorney, Agent, or Firm*—Richard H. Thomas

[57] ABSTRACT

A carton having both shipping and display modes suitable for both shipping and displaying a plurality of rectangular, thin, relatively flexible pouches, said pouches having graphics on the front sides thereof and being stackable in a generally upright, in-file fashion in said carton, comprising; a plurality of connected panels defining a generally rectangular hexahedron shape, and including opposed front and back panels, a bottom panel, and opposed side panels extending between the front and back panels, said front panel comprising a display part open in an amount effective to display said pouch indicia; at least one of said side panels comprising an inwardly extending tab portion having a separated free edge adapted to engage said pouch edges and retain said pouches in a generally upright position, said front and side panels having machine-cut exposed edges.

2 Claims, 7 Drawing Figures

DISPLAY CARTON

TECHNICAL FIELD

The present invention relates to a carton having both shipping and display modes, and to the blank from which that carton is formed.

The carton of the present invention is particularly useful for shipping and displaying small, thin, somewhat flexible pouches or foils such as those found on grocery supermarket shelves containing sauce, gravy and seasoning dry mixes. However, it will be apparent to those skilled in the art that the invention has other applications, for instance, display of foils or pouches containing non-food ingredients.

BACKGROUND ART

It is known to provide cartons useful for both shipping and displaying thin, rectangular packets of food ingredients. These cartons have a generally rectangular hexahedron shape, when in a shipping mode, comprising front, back and side panels. The top panel and a major portion of the front panel are attached to the remaining panels of the carton along scored lines, permitting separation or ready removal of the top and front panels to prepare the carton for its display mode. On removal of said panels, the contents of the carton are exposed from both the front and top sides.

One problem with this design is that the scoring leaves rough, somewhat jagged edges following separation, which are clearly visible and detract from the carton general appearance. Another problem is that the carton surfaces which are visible during display are also exposed during shipping. These surfaces conveniently bear trademarks, indicia, and other graphics identifying and/or advertising the pouch goods being displayed. During shipping, such graphics can become damaged from abrasion or scuffing, further detracting from the appearance of the carton. Also, the cartons, during shipping, have a single wall thickness which provides inadequate support strength when the cartons are stacked, making the cartons subject to squashing and distortion, potentially further detracting from carton appearance.

The displayed pouches usually carry substantial goods identification and graphics similar to that on the carton, identifying and advertising the goods being marketed. To make as much of such graphics visible, the scoring along the front side, ideally, is arranged to expose as much of the pouch front sides as possible. This permits the pouches, which are in in-file alignment in the cartons to slump or fall forward, and even out of the carton when on a display shelf.

The cartons can be manufactured for either two in-file rows of single-width packets, or a single row of in-file double-width pouches. In the case of the former, a fairly high divider can be placed between the two rows of pouches, providing sufficient friction engagement with the pouches to hold them in generally upright position. However, the divider would then have to be sufficiently hight that it could not be folded flat in the bottom of the carton if the carton was to be used for a single row of double-width pouches. This means that, conventionally, is has been necessary to manufacture the cartons from a plurality of different blanks, depending upon the configuration of shape of the pouches being shipped and displayed.

Prior U.S. Pat. No. 3,669,251 discloses a combination shipping and display carton for holding tobacco foils or pouches in an upright position. A blank of material is formable into a shipping carton, which is convertible to a display carton by removal of a top part of the carton tearing along weakened lines in the front and side panels. Exposed side edges of the carton, following tearing, have curved article-engaging outlines adapted to engage the foils or pouches being displayed, preventing them from tipping forward or backward. The carton of this patent is made of paperboard, not corrugated board, and would suffer from the disadvantages of the art discussed above; for instance, in showing ragged, rough edges and, also, in the lack of means to prevent damage to the carton graphics or the carton itself during shipping. Likely, actual shipping would require positioning ten or so of the cartons in a strong master carton, rather than shipping the cartons individually.

DISCLOSURE OF INVENTION

The present invention overcomes the above disadvantages in the provision of a carton having both shipping and display modes suitable for both shipping and displaying a plurality of rectangular, thin, relatively flexible pouches, said pouches having graphics on the front sides thereof and being stackable in a generally upright, infile fashion in said carton, comprising; a plurality of connected panels defining a generally rectangular hexahedron shape, and including opposed front and back panels, a bottom panel, and opposed side panels extending between the front and back panels, said front panel comprising a display part open in an amount effective to display said pouch indicia; at least one of said side panels comprising an inwardly extending tap portion having a serrated free edge adapted to engage said pouch edges and retain said pouches in a generally upright position, said front and side panels having machine or die-cut exposed edges.

Preferably, the carton, of the present invention, in its shipping mode, has a top panel which is connected to the back panel along scored lines for easy separation of the top panel from the back panel, towards preparation of the carton for its display mode. The top panel has attached to it, and removable with it, a front panel which overlies said display part and second side panels which overlie the first-mentioned side panels.

Advantages of the present invention are a positive means to hold the in-file pouches in a generally upright position, double wall protection and stack strength of the carton when in a shipping mode; and clean, machine-cut exposed edges for the carton when in a display mode. Also, it will become apparent that the cartons of the present invention can be formed from a single blank, and are functional with pouches of different sizes or widths. For purposes of the present application, a machine or die-cut edge is one formed when manufacturing the carton blank, as contrasted with a scored edge formed on separating one panel from another.

BRIEF DESCRIPTION OF DRAWINGS

The present invention and the advantages thereof will become more apparent upon consideration of the following specification, with reference to the accompanying drawings, in which.

BEST MODE FOR CARRYING OUT THE INVENTION AND INDUSTRIAL APPLICABILITY

Figure 1:
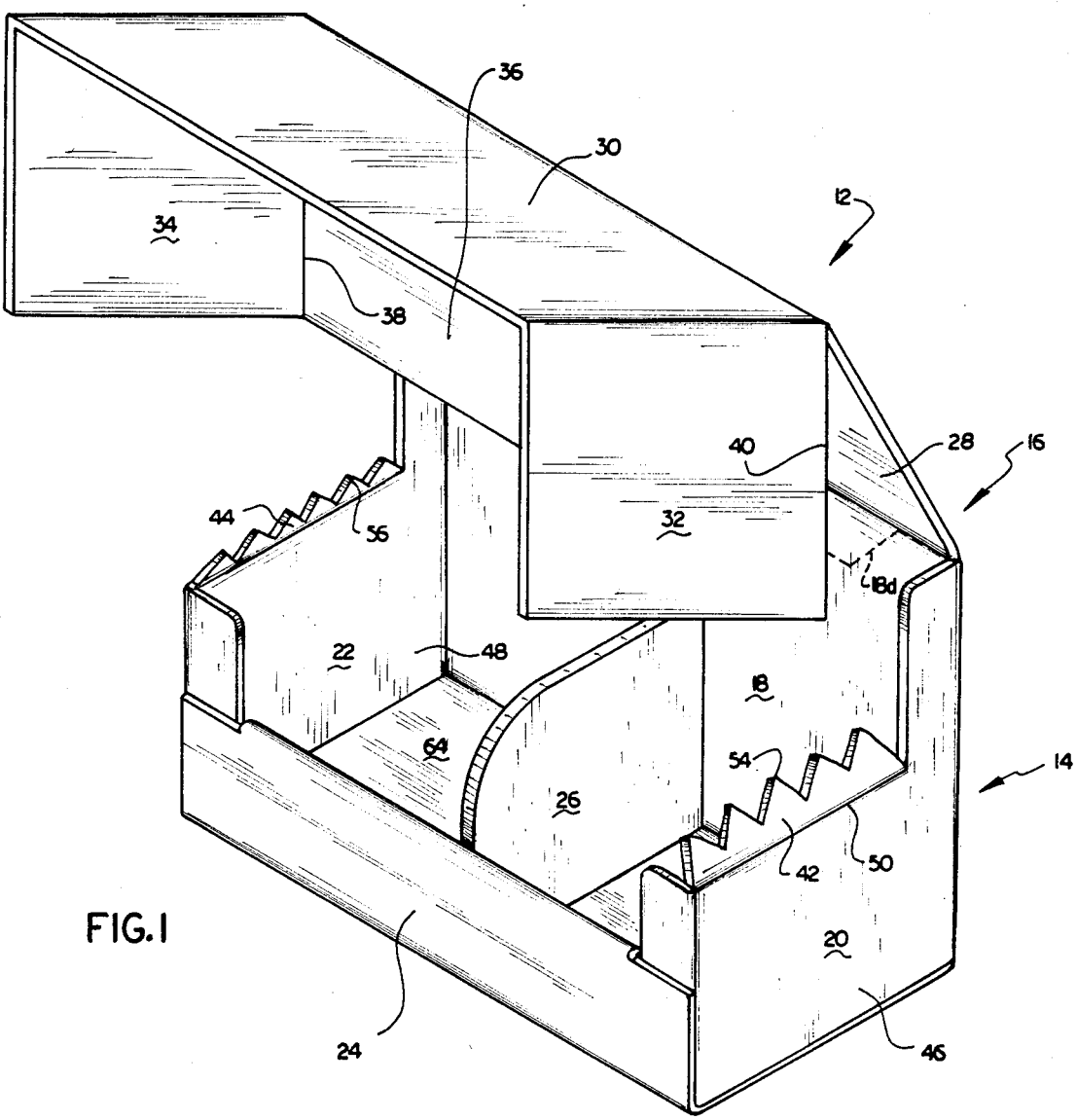
FIG. 1 is a perspective view of a partially opened carton incorporation the concepts of the present invention.

Referring to the drawings, and in particular FIG. 1, the carton 12 of the present invention comprises a lower display mode portion 14 and a shipping mode portion 16. The display mode portion 14 comprises a back panel 18, side panels 20 and 22, a display mode front part 24 and divider 26.

Figure 1A:
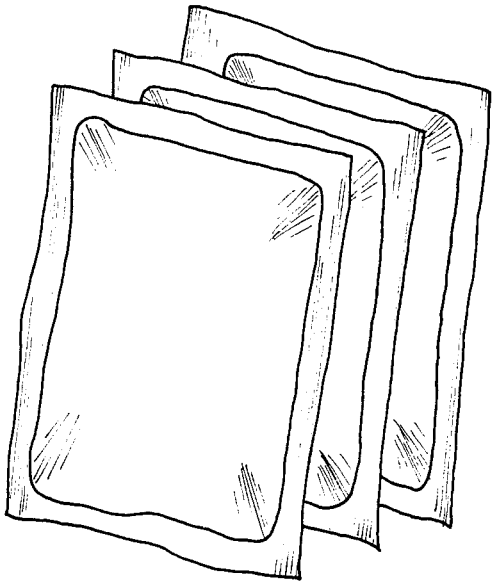
FIG. 1A is a perspective view of foils or pouches in in-file array.

The type of foil or pouch adapted to be held and displayed in the carton of FIG. 1 is shown in FIG. 1A. Essentially, such foils or pouches are rectangular in shape, relatively thin and thus flexible, and by way of example, may be made of a laminate comprising layers of paper, heat-sealable plastic and, optionally, aluminum foil, if moisture barrier properties are desired. They are adapted to contain a plurality of different items such as sauces, dry gravy mixes, flavorants, seasonings, and other food condiments. The present invention is not limited to foils or packages useful only for marketing food condiments. Other products such as glue materials, and the like, are frequently marketed in pouches of foils of this type. A characteristics of the foils and pouches is that they bear on the front side, at least, trade names and advertising material, indicia and the like, which can broadly be characterized as graphics.

The foils or pouches are adapted to be positioned in in-file alignment in the cartons; that is, in front-to-back relationship. The foils or pouches can be of single width size, placed in two side-by-side rows on opposite sides of divider 26, or alternatively, can be of double-width size extending substantially full width between sides 20 and 22 of the carton. In such case, the divider 26, as will be explained, in positioned to lie flat in the bottom of the carton so that it does not impede in-file positioning of the foils or pouches.

It will also be apparent that the carton of the present invention can be adapted to handle additional rows of in-file pouches, or pouches of different shape or configuration from those shown in FIG. 1A.

Returning of FIG. 1, the shipping mode portion of the carton of the present invention comprises a top panel 28, a front panel 30, adapted to overlie the display mode front part 24 when the carton is in a closed shipping mode, and opposite side panels 32 and 34, adapted to overlie the side panels 20 and 22, again, when the carton is in a closed shipping mode.

Also shown in FIG. 1 is a top inner flap 36 connected along fold line 38 to the side panel 34. A similar flap (not shown in FIG. 1) is attached to side panel 32, along fold line 40. When the front 30 is brought down so that it overlies display mode front part 24, with the side panels 32 and 34 overlying the sides 20 and 22, the flap 36 and the one not shown are brought up against the top panel 28, on the inside surface thereof, providing double wall thickness across the top for the carton when in its shipping mode. The flap 36 and its counterpart, attached to panel 32, are purposely rectangular shaped and, thus, function to hold the two side panels 32 and 34 firmly against sides 20 and 22 when the carton is closed. This means that the only added closure aid needed for shipping is a strip of tape securing front panel 30 to the bottom of the carton.

A key feature of the present invention is the provision of serrated horizontal edge tabs 42 and 44. As shown in FIG. 1, the side panels 20 and 22 are ell shaped, with the edge tabs 42 and 44 being connected along the top edges of the lower legs 46 and 48 of the side panels. The fold lines 50 and 52 for the tabs 42 and 44 are formed so that the tabs bend naturally slightly inwardly. Serrated edges 54 and 56, along the upper edges of the tabs, are adapted to grip the edges of foils of packets positioned in the carton in in-file array, preventing the foils or pouches from falling forward and out of the carton when it is in its display mode. The specific configuration of the serrated edges 54 and 56 is not critical, and is dependent, in part, on the thickness and shape of the foils or pouches to be retained. In most cases, the foils or pouches will have very thin edges, and a thickness in the body of the pouch of about $\frac{3}{8}''$, plus or minus. In the embodiment illustrated, the distance from one apex to another of the serrated edges is about $\frac{1}{2}''$. The carton illustrated is adapted to retain, in each file, about 8–12 foils or pouches. This would be the case even where the pouches were of double width.

Although it will become more apparent on further description of the present invention, the shipping mode portion 16 is connected to the display mode portion 14 by means of scored lines 18*d* (FIG. 2) extending across the width of the carton. When a receiver of the carton wishes to prepare it for its display mode, the shipping mode portion 16 is simply raised from the display mode portion, for instance, to the position shown in FIG. 1, and then torn away from the display mode portion along scored line 18*d*, and discarded. The display mode portion and its contents are then quickly readied or prepared for positioning on a shelf.

At this point, it should be noted that the carton will usually contain graphics on the outside of the top panel 28 and front panel 30 and, perhaps, side panels 32 and 34. However, more important, for the benefit of the ultimate consumer, the carton will contain graphics, particularly trademarks and advertising material, on the display mode front part 24 and side panels 20 and 22, in addition to the graphics on the individual foils or pouches. It is a feature of the present invention that the side panels 32 and 34 protect the graphics on sides 20 and 22 during shipping, as does front panel 30 with regard to the display mode front part 24.

It should be noted that because of the design of the carton of the present invention, double wall strength is provided along the sides, top and front of the carton when in its shipping mode, protecting the carton against crushing or distortion during stacking.

Of substantial importance, the design of the carton permits the exposed serrated edges 54 and 56 to be machine of die cut rather than formed by tearing along a scored line, presenting a clean, smooth appearance rather than a jagged one. Also of advantage, the clean cut provides a better grip on the pouch or foil edges than would otherwise be obtained.

Figure 2:
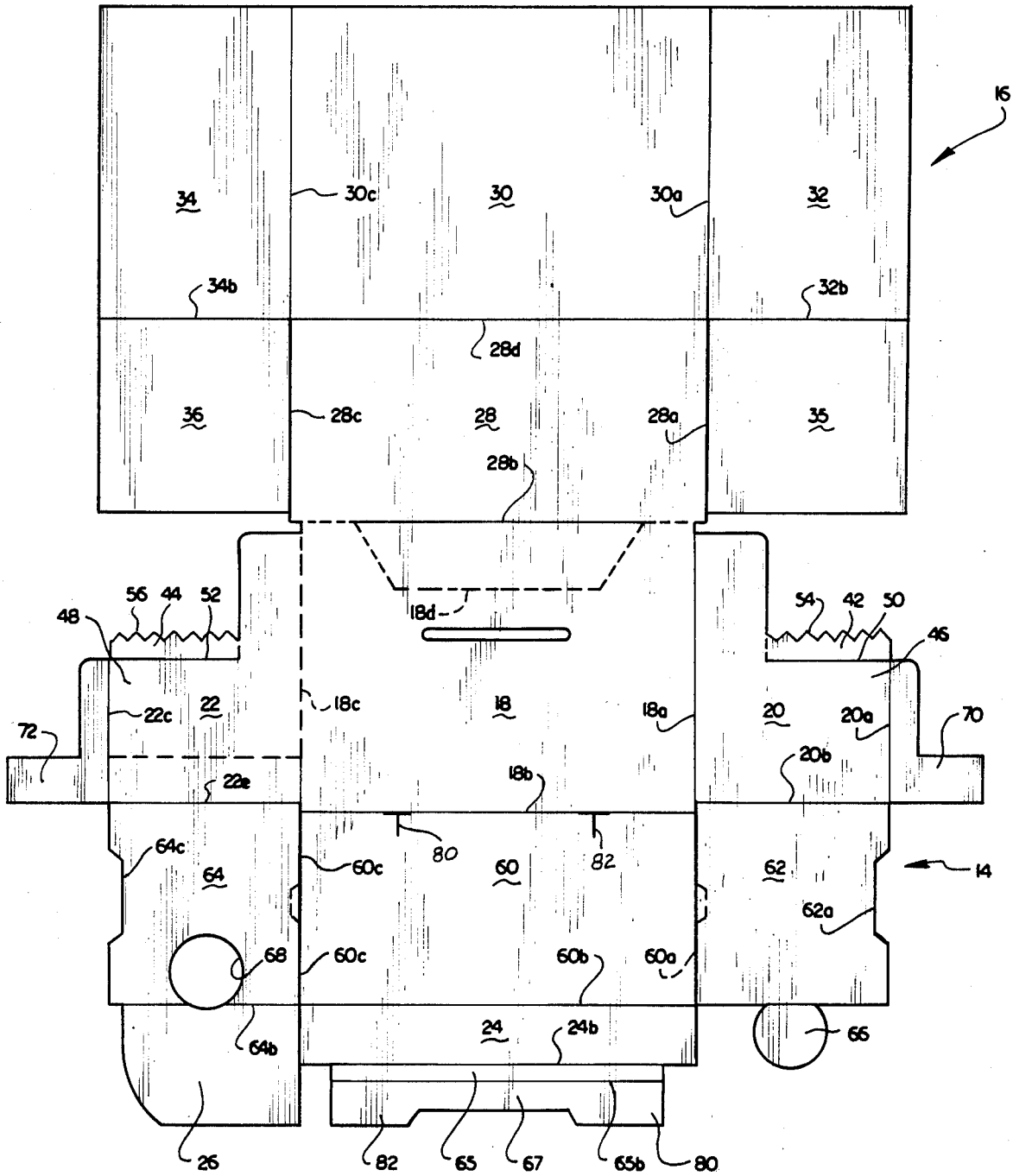
FIG. 2 is a plan view of a blank from which the carton of FIG. 1 is prepared.

Details of the blank from which the carton of the present invention is made are shown in FIG. 2. Preferably, the blank is made from bleached, white board, which provides a pleasing appearance.

Referring to FIG. 2, shown is the back panel 18 which is of a generally rectangular shape comprising, in a clock-wise direction, first, second, third and fourth edges, identified by the numerals 18*a*, 18*b*, 18*c* and 18*d*, respectively. The ell shaped side panels 20 and 22 are connected to the opposite first and third edges 18*a* and 18*c*, respectively, of the back panel 18. The panels 20 and 22 have lower legs 46 and 48, which extend outwardly from the back panel 18 along fold lines 20*b* and 22*b*, which are substantially aligned with the fold line 18*b*.

The blank also comprises bottom panel 60 (not shown in FIG. 1) connected to the back panel 18 along fold line 18*b*. A bottom inner pair of panels 62 and 64 are attached to side panels 20 and 22 along fold lines 20*b* and 22*b*, respectively. The panels 62 and 64 are separated from the bottom panel 60 by cut lines 60*a* and 60*c*. The display mode front part 24 is shown as connected to the bottom part 60 along the fold line 60*b*. Integral with the front part 24 are lock-forming parts 65 and 67, to be described, part 65 being attached to part 24 by fold line 24*b* and part 67 being attached to part 65 by fold line 65*b*.

Also shown in FIG. 2, with regard to the display mode, is divider 26, attached to the bottom inner panel 64 along fold line 64*b*; tabs 42 and 44 attached along the upper edges of legs 46 and 48, along fold lines 50 and 52; and serrated edges 54 and 56 of the tabs.

The shipping mode portion of the carton comprises top panel 28 attached to the back panel 18 along scored line 18*d*, to be described. Also shown is the front panel 30, connected to the top panel 28 along fold line 28*d*; outer side panels 32 and 34 connected to the top panel 30 by fold lines 30*a* and 30*c*; and top inner flaps 35 and 36 connected to the side panels 32 and 34, respectively, along fold lines 32*b* and 34*b*, respectively. As shown in FIG. 2, the top inner flaps 35 and 36 are separated from the top panel 28 along cut lines 28*a* and 28*c*.

By scoring the line 18*d* between back panel 18 and top panel 28, the shipping mode portion 16 is readily separated from the display mode portion 14 by pulling along the scored line. The exact configuration of the scored line is not critical, although, preferably, it has the shape shown, cut in the shape of a shallow, sloping-sided dish. This makes it easier for the ultimate consumer to reach in and grab the upper edge of a foil or pouch, particularly ones positioned near the back of the carton. Also shown in FIG. 2 is straight fold line 28*b*, which allows the top panel 28 to be folded down relative back panel 18, part of scored line 18*d* coinciding with fold line 28*b*.

Figure 3:
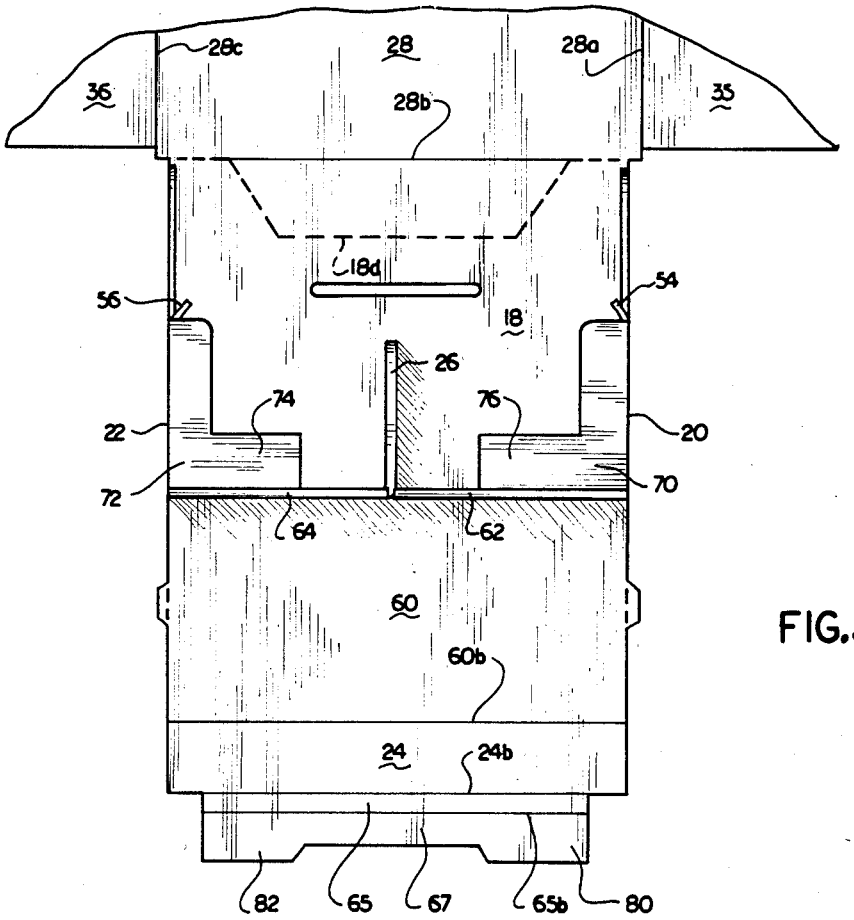
FIG. 3 is a view with certain panels of the blank of FIG. 2 in a folded position.

FIG. 3 shows the carton display mode portion partly folded. In the stage of FIG. 3, the bottom inner panels 62 and 64 are folded upwardly along fold lines 20*b* and 22*b* (FIG. 2), relative to side panels 20 and 22, and then the side panels 20 and 22 are folded upwardly along fold lines 18*a* and 18*c*, relative to back panel 18. This latter step brings the bottom inner panels 62 and 64 together. Inner panel 62 is provided with a tab portion 66 and inner panel 64 is provided with aperture means 68. Divider 26 is folded upwardly, relative to bottom inner panel 64, exposing the aperture means 68, allowing the tab 66 to lock into the aperture means 68, locking the two bottom inner panels 62 and 64 together. This, in addition, locks the side panels 20 and 22 in an upright position, relative to the back panel 18 (and plane of the drawing of FIG. 3).

Integral with the side panels 20 and 22 are ell-shaped tabs 70 and 72 connected to the side panels 20 and 22 along fold lines 20*a* and 22*c*, respectively. Referring to FIG. 3, with the sides 20 and 22 in an upright position relative to the back panel 18, the ell-shaped tabs are bent inwardly towards each other to lie along the front plane of the carton parallel to the back panel 18. As shown, the tabs 70 and 72 comprise lower legs 74 and 76.

Figure 4:
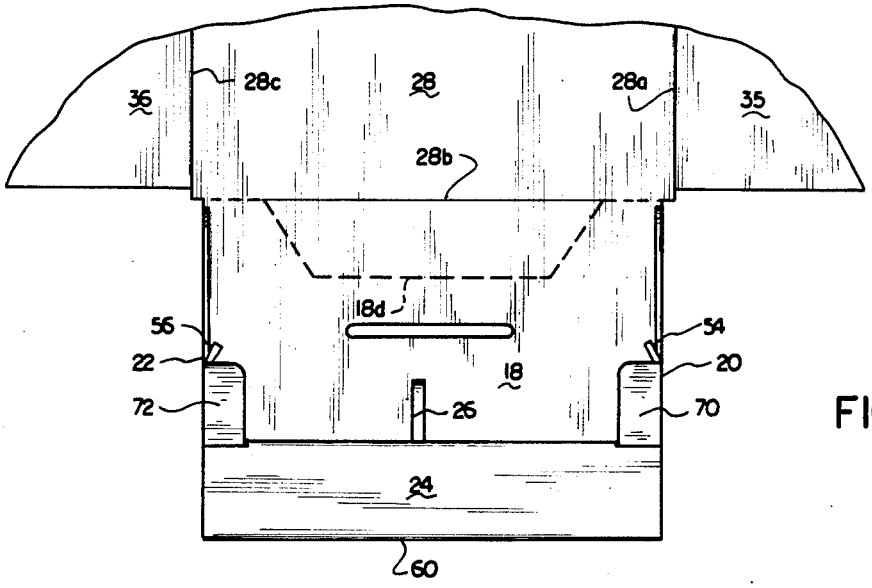
FIG. 4 is a view of the carton of the present invention with additional panels of the blank of FIG. 2 in a folded position.

FIG. 4 shows the carton of the present invention in a further folded position, in which the bottom panel 60 (FIG. 3) is folded upwardly along fold line 18*b* (FIG. 2) so that it is at right angles to the back panel 18. This permits lock-forming parts 65 and 67 (FIG. 3) to be folded along fold lines 24*b* and 65*b* into a "U" shape around legs 74 and 76 of tabs 70 and 72. Protrusions 80 and 82 of part 67 lock into indentations 62*a* and 64*c* of bottom inner panels 62 and 64. When the inner panels 62 and 64 are folded upwardly and then locked together, as in FIG. 3, the bottom outer panel 60 lies against these inner panels and the spacing of indentations 62*a* and 64*c* is that necessary to receive the protrusions 80 and 82.

To summarize, FIGS. 2, 3 and 4 are views looking down on the back side 18 of the carton, or viewing the carton from the front (particularly FIGS. 3 and 4). In FIG. 3, the display mode is in partially folded condition with the sides 20 and 22, bottom inner panels 62 and 64 (locked together by tab 66 and aperture 68), ell-shaped tabs 70 and 72, and divider 26 all in place. Not folded into place is outer bottom panel 60 and its associated parts. In FIG. 4, the bottom outer panel 60 is then folded up into place, so that it overlies bottom inner panels 62 and 64 and lock-forming parts 65 and 67 are folded over legs 74 and 76 of the tabs 70 and 72, providing a finished and smooth appearance along the front in addition to completing the display mode portion of the carton and locking the integral parts together.

Figure 6:
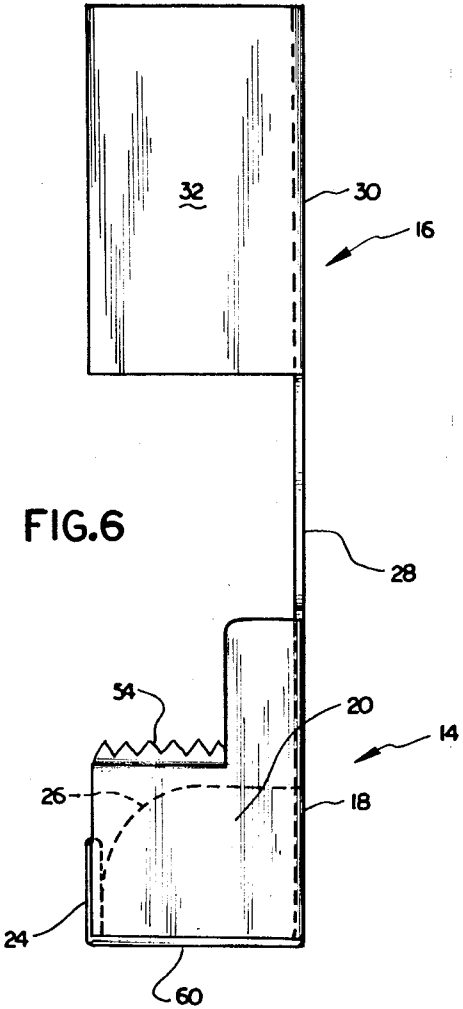
FIG. 6 is a side view of the carton of FIG. 5.
Figure 5:
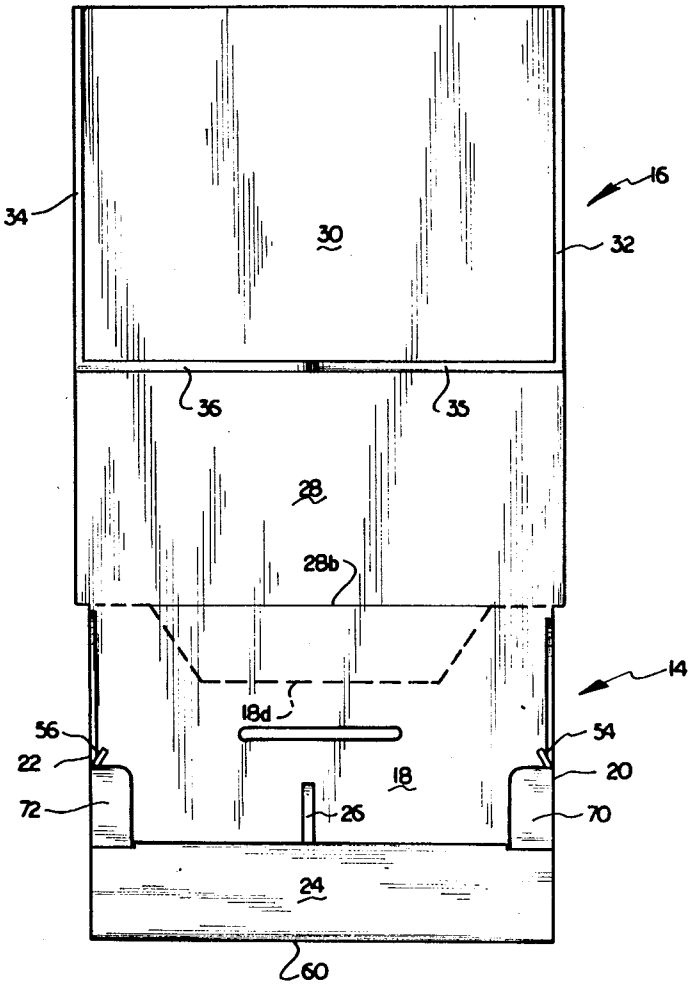
FIG. 5 is a front view of the carton of FIG. 1 with the top panels thereof in a raised position.

FIGS. 5 and 6 show both the display and shipping mode portions of the carton in a fully folded position, but the carton itself open. In FIG. 5, side panels 32 and 34 of the upper shipping mode portions are folded inwardly along fold lines 30*a* and 30*c* (referring to FIG. 2) and, in addition, the top inner flaps 35 and 36 are similarly folded along fold lines 32*b* and 34*b* (referring to FIG. 2). Bringing the panels 30 and 28 down causes the sides 32 and 34 to overlap the sides 20 and 22 of the display mode portion. Also, this brings inner flaps 35 and 36 against the top panel 28, affording, as mentioned, double wall protection along the top and sides of the carton.

In a feature of the invention, shown in FIG. 2 the side panel 22 is scored along line 18*c* and also along a line 22*e*, extending parallel to the fold line 22*b*, but slightly above it. This permits a large part of side panel 22 to be pulled away from the carton, exposing the side of the carton, in addition to the front exposure. In some instances, space on a supermarket shelf may be limited, mandating that the cartons be placed on the shelves with an end exposed rather than the front. By being able to remove a large part of side panel 22, the contents of the carton are better exposed despite the end alignment of the carton. In this type of situation, the in-file alignment of the pouches or foils would be longitudinally in the carton.

In FIG. 2, there are shown two tee-shaped cuts 80 and 82 positioned in the bottom panel 60, near the back along fold line 18*b*. This purpose is to receive wire clips adapted to off-shelf suspend the carton in the event display shelf space is limited.

In the description of the present invention, with regard to FIGS. 3 and 4, it was disclosed that the front of the carton was formed by folding parts 65 and 67 of the front part 24 over the legs 74 and 76 of the ell-shaped tabs 70 and 72 (FIG. 3). The parts 65 and 67 are locked into place by insertion of protrusions 80 and 82 into indentations 62*a* and 64*c* of inner bottom panels 62 and 64. As an alternative to this construction, front part 24 can be provided with glue points adapted to secure the part directly to the legs 74 and 76 of tabs 70 and 72. This has the advantage of eliminating a folding step in the carton assembly.

In this regard, an advantage of the present invention is in other step reductions over processes of the prior art. For instance, it was mentioned that in prior art constructions it was necessary to provide a divider tab which was insertable into the carton to adapt it to support parallel rows of in-file pouches. This required cutting the tab from a separate blank, and the additional insertion step. In the present invention, the divider tab 26 is an integral part of the carton blank and can be raised in an in-use position as shown in FIG. 1, or laid flat in the bottom of the carton, against panel 60, as desired. For this purpose, the tab, during forming of the blank, preferably is machine compressed to reduce its cross thickness.

To summarize the features of the present invention with regard to protection during shipping, it is apparent that the present invention affords double wall thickness along the bottom, both sides and top of the carton. In addition, outer panels protect indicia on the display mode, carton front and sides, from damage during shipping. Again, a single carton blank provides a versatile assembly which is adaptable to display of a variety of pouches or foils of different configurations and sizes. Further exposed edges of the carton display mode are machine cut or folded for enhanced appearance.

I claim:

1. A carton blank adaptable for folding into a generally rectangular hexahedron shape having both shipping and display modes, for shipping and displaying a plurality of rectangular, thin relatively flexible pouches, said pouches having graphics on the front sides thereof and being stackable in a generally upright, in-file fashion in the carton, comprising:

a rectangular back panel comprising, in a clock-wise direction, first, second, third and fourth edges;

ell-shaped side panels attached along fold lines to the opposite first and third edges, the lower legs of said side panels extending outwardly from the back panel and having lower edges generally aligned with the back panel second edge;

a generally rectangular bottom outer panel attached along a fold line to the back panel second edge;

each side panel comprising a tab portion parallel but spaced from said lower edges and having a serrated free edge, said tab portion being foldable relative the side portion to engage said pouch edges when the carton blank is folded to its display mode and the pouches are in place in the carton;

said serrated free edge being machine or die cut;

a generally rectangular top panel connected along a fold line to the back panel fourth edge;

a generally rectangular front panel having in a clockwise direction first, second, third and fourth edges wherein the front panel second edge is connected along a fold line to the top panel edge opposite said back panel fourth edge;

overlying side panels connected to the front panel along said front panel first and third edges adapted to overlie said ell-shaped side panels when the blank is in a closed shipping mode;

overlying bottom panels connected along fold lines to the ell-shaped panels lower edges adapted to overlie the bottom panel when the blank is in a closed shipping mode.

further including a scored line for separation of the top and back panels and conversion of the carton blank from a shipping mode to a display mode.

2. The carton blank of claim 1 further comprising inner top panels connected along fold lines to said overlying side panels adapted to lie against the first-mentioned top panel when the carton is in a folded position.

* * * * *